US006327428B1

(12) United States Patent
Lo et al.

(10) Patent No.: US 6,327,428 B1
(45) Date of Patent: Dec. 4, 2001

(54) PORTABLE DRYER WITH DIFFERENT CIRCUIT DESIGNS

(75) Inventors: Teh-Liang Lo; Te-Yu Lo, both of Hsin-Tien; Shun-Ping Wang, Chia-I, all of (TW)

(73) Assignee: Tech Maker Corp., Taipei (TW)

( * ) Notice: Subject to any disclaimer, the term of this patent is extended or adjusted under 35 U.S.C. 154(b) by 0 days.

(21) Appl. No.: 09/614,562

(22) Filed: Jul. 12, 2000

(30) Foreign Application Priority Data

Jul. 16, 1999 (TW) ..... 88112120 A

(51) Int. Cl.[7] ..... A45D 20/10; F24H 3/00

(52) U.S. Cl. ..... 392/385; 392/384; 34/97; 219/480

(58) Field of Search ..... 392/379–385, 392/360, 363–365, 366–369; 219/476, 480; 34/96, 97

(56) References Cited

U.S. PATENT DOCUMENTS 1,573,944 * 2/1926 Jancke ..... 392/384
1,607,195 * 11/1926 Gross ..... 392/383
2,647,198 * 7/1953 Lautner ..... 392/365
2,786,173 * 3/1957 Martin et al. ..... 219/202
3,131,281 * 4/1964 Jepson ..... 392/384
4,757,183 * 7/1988 Karey et al. ..... 392/385
5,195,253 * 3/1993 Poumey et al. ..... 34/97
5,394,620 * 3/1995 Chimera ..... 34/97
5,825,974 * 10/1998 Hutton et al. ..... 392/360
5,940,980 * 8/1999 Lee et al. ..... 34/97

FOREIGN PATENT DOCUMENTS

3429319 * 2/1986 (DE) .
29708171 * 7/1997 (DE) .
2117194 * 10/1983 (GB) ..... 392/360
2299755 * 10/1996 (GB) .

* cited by examiner

*Primary Examiner*—John A. Jeffrey
(74) *Attorney, Agent, or Firm*—Winston Hsu

(57) ABSTRACT

A portable dryer includes a housing, a motor installed with a fan inside the housing, an electric heating device electrically connected to the motor for generating heat, a switch electrically connected to the motor, and a battery for supplying electric power to the portable dryer. When the switch is turned on, the battery can supply electric power to the motor and the electric heating device, making the electric heating device generate heat and the motor drive the fan and thus blowing out hot air generated by the electric heating device.

19 Claims, 15 Drawing Sheets

| Type I | | | | | | |
|---|---|---|---|---|---|---|
| (I-1) | DCM | R1A | Rdcm+R1A | | | Total |
| Resistance Ω = | 2.00 | 20.00 | 22.00 | | | 22.00 |
| Current DC I = | 1.82 | 1.82 | 1.82 | | | 1.82 |
| Voltage DC V = | 3.64 | 36.36 | 40.00 | | | 40.00 |
| Power DC W = | 6.61 | 66.12 | 72.73 | | | 72.73 |
| | | | | | | |
| (I-2) | DCM | R1A | Rdcm+R1A | R2 | R-total | Total |
| Resistance Ω' = | 2.00 | 20.00 | 22.00 | 40.00 | 14.19 | 14.19 |
| Current DC I' = | 1.82 | 1.82 | 1.82 | 1.00 | 2.82 | 2.82 |
| Voltage DC V' = | 3.64 | 36.36 | 40.00 | 40.00 | 40.00 | 40.00 |
| Power DC W' = | 6.61 | 66.12 | 72.73 | 40.00 | 112.73 | 112.73 |
| | | | | | | |
| Motor power ratio : $W'_{DCM}/W_{DCM}$ = 1.00 | | | | | | W'/W=1.55 |

Fig. 6

| Type II | | | | | | |
|---|---|---|---|---|---|---|
| (II-1) | DCM | R1A | | | Rdcm+R1A | Total |
| Resistance Ω = | 2.00 | 20.00 | | | 22.00 | 22.00 |
| Current DC I = | 1.82 | 1.82 | | | 1.82 | 1.82 |
| Voltage DC V = | 3.64 | 36.36 | | | 40.00 | 40.00 |
| Power DC W = | 6.61 | 66.12 | | | 72.73 | 72.73 |
| | | | | | | |
| (II-2) | DCM | R1A | R1B | R1A//R1B | Rdcm+R1 | Total |
| Resistance Ω' = | 2.00 | 20.00 | 42.00 | 13.55 | 15.55 | 15.55 |
| Current DC I' = | 2.57 | 1.74 | 0.83 | 2.57 | 2.57 | 2.57 |
| Voltage DC V' = | 5.15 | 34.85 | 34.85 | 34.85 | 40.00 | 40.00 |
| Power DC W' = | 13.24 | 60.74 | 28.93 | 89.67 | 102.90 | 102.90 |
| | | | | | | |
| Motor power ratio : $W'_{DCM}/W_{DCM}$ = 2.00 | | | | | | W'/W = 1.41 |

Fig. 10

Type III

| (III-1) | DCM | R1A | Rdcm+R1A | Total |
|---|---|---|---|---|
| Resistance Ω = | 2.00 | 20.00 | 22.00 | 22.00 |
| Current DC I = | 1.82 | 1.82 | 1.82 | 1.82 |
| Voltage DC V = | 3.64 | 36.36 | 40.00 | 40.00 |
| Power DC W = | 6.61 | 66.12 | 72.73 | 72.73 |

| (III-2) | DCM | R1A | R1B | R1A//R1B | Rdcm+R1 | R2 | R-total | Total |
|---|---|---|---|---|---|---|---|---|
| Resistance Ω' = | 2.00 | 20.00 | 42.00 | 13.55 | 15.55 | 30.00 | 10.24 | 10.24 |
| Current DC I' = | 2.57 | 1.74 | 0.83 | 2.57 | 2.57 | 1.33 | 3.91 | 3.91 |
| Voltage DC V' = | 5.15 | 34.85 | 34.85 | 34.85 | 40.00 | 40.00 | 40.00 | 40.00 |
| Power DC W' = | 13.24 | 60.74 | 28.93 | 89.67 | 102.90 | 53.33 | 156.24 | 156.24 |

Motor power ratio : $W'_{DCM} / W_{DCM} = 2.00$ $W'/W = 2.15$

Fig. 14

PORTABLE DRYER WITH DIFFERENT CIRCUIT DESIGNS

BACKGROUND OF THE INVENTION

1. Field of Invention

The present invention relates to a portable dryer. More particularly, to a portable dryer with different circuit designs.

2. Description of the Related Art

The conventional dryer is operable only after establishing connection with an AC power plug through a power cord. The use of the dryer is then limited by the length of the cord to the area that can be reached by the cord from the AC power receptacle. Therefore, it is very inconvenient for travelling purposes. In particular, when traveling in countries where the AC power specifications, such as voltages, cycles, and receptacles, that varies from one to another. Different converters and transformers are needed if the user wants to use a conventional dryer. Furthermore, since the conventional AC powered dryers are powered by AC currents with sinusoidal amplitudes, mostly using a diode to control the generation of heat. When the switch is shifted to low heat, the one-way conduction property of the diode filters out a half cycle of the AC current that passes through the heating filament. When the switch is shifted to high heat, the current to the heating filament does not go through the diode so that heat can be generated in full output. At the same time, in order to provide a DC current for the motor, an additional bridge rectifier has to be employed to supply the needed DC power.

SUMMARY OF THE INVENTION

It is therefore an object of this invention to provide a portable dryer that is operable without the need of connecting to an AC power receptacle.

It is another object of the present invention to provide a portable dryer, through a switch controlling an electric heating device therein, different strengths of heat can be generated and the motor therein can run at different speeds so that the fan blows out different airflow and heat for the convenience of the user.

According to one embodiment of the invention, the portable dryer includes a housing, a motor having a fan installed inside the housing, an electric heating element electrically coupled to the motor for generating heat, a switch electrically coupled to the motor, and a battery for supplying electric power to the portable dryer. When the switch is turned to the on position, the battery supplies electric power to the motor and the electric heating element, causing the electric heating element to generate heat, and the motor to drive the fan and thus blowing out hot air generated by the electric heating element. Moreover, the portable dryer can be arranged so that the speed of the motor can be controlled by the switch to obtain different levels of airflow.

It is an advantage of the present invention that the portable dryer is operable without a power cord, so that a user can use it without connecting the dryer to an AC power receptacle.

It is another advantage of the present invention that the speed of the motor be controlled by a switch to obtain different levels of airflow.

These and other objectives of the present invention will no doubt become obvious to those of ordinary skill in the art after reading the following detailed description of the preferred embodiment which is illustrated in the various figures and drawings.

BRIEF DESCRIPTION OF THE DRAWINGS

FIG. 6 shows the calculation of power generated from the first circuit in FIGS. 3–5.

FIG. 10 shows the calculation of the power generated from the second circuit in FIGS. 7–9.

FIG. 14 shows the calculation of the power generated from the third circuit in FIGS. 11–13.

DETAILED DESCRIPTION OF THE PREFERRED EMBODIMENT

Figure 1:
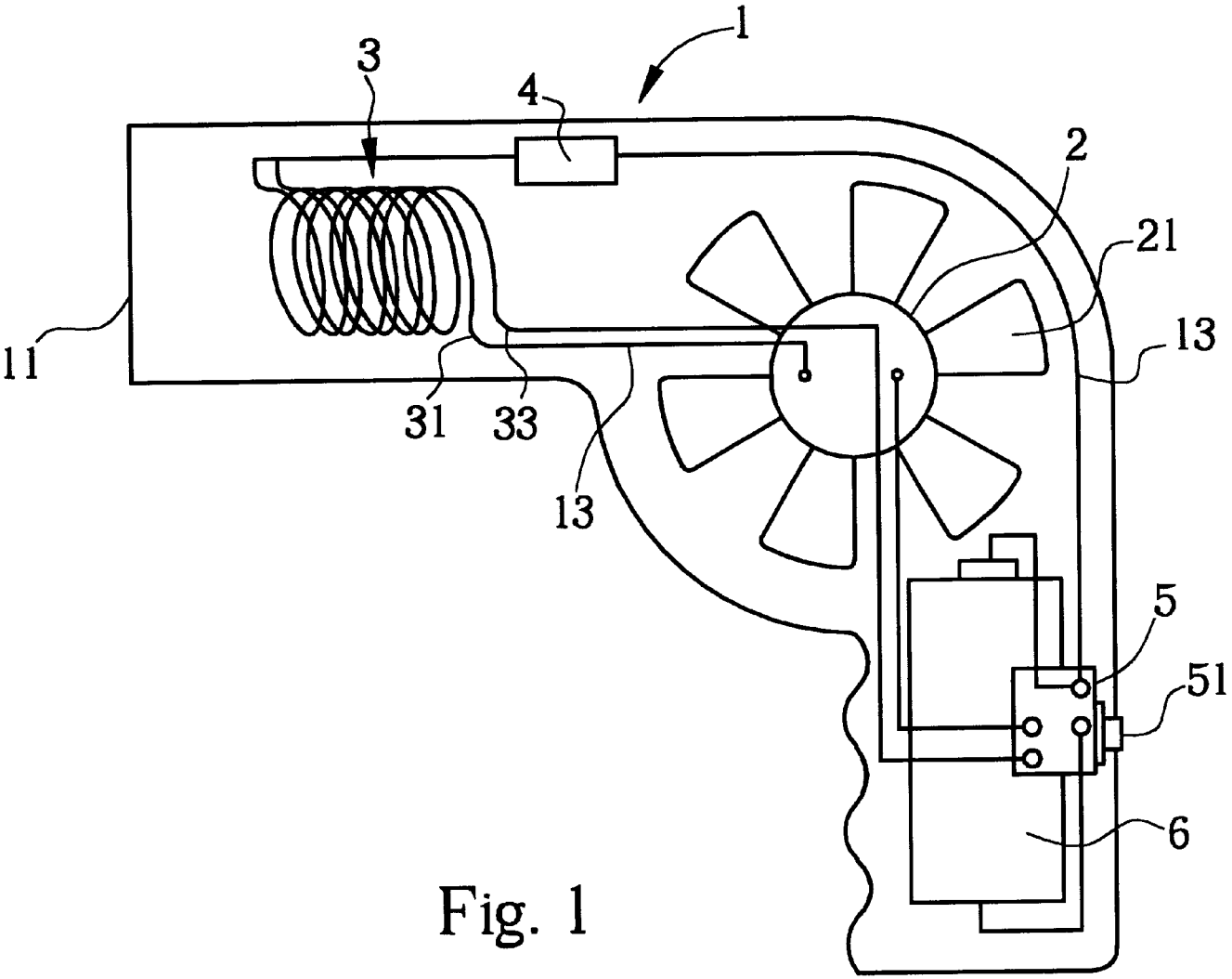
FIG. 1 is a schematic view of a portable dryer according to one embodiment of the present invention.

Refer to FIG. 1 now, which is a schematic view of a portable dryer according to one embodiment of the present invention. The portable dryer has a housing 1 with an opening 11 on one end thereof, a motor 2 installed inside the housing 1, an electric heating element 3 electrically coupled to the motor 2 for generating heat, and an overload protection device electrically coupled to a battery that supplies the electric power, for preventing damages of the portable dryer. In the preferred embodiment, the overload protection device 4 is a fuse. However, this should not be construed to mean that only fuses can be used as overload protection devices. The portable dryer further includes a switch 5 electrically coupled to the motor 2, the battery 6, the switch 5, the motor 2, and the electric heating element 3.

The battery 6 can be a storage battery, dry-cell battery or a rechargeable battery. It is connected to the switch 5, the motor 2, the electric heating element 3 and the overload protection device 4 via wires 13, forming a closed circuit loop. A fan 21 is coupled to the motor 2 so that the motor 2 can rotate the fan 21 to produce airflow. The electric heating element 3 comprises a first heating filament 31 and a second heating filament 33 (in the current embodiment, the first and second heating filaments 31, 33 each can be formed by more than one heating filament) . The first heating filament 31 first connects to the motor 2 in series, which are then connected to the second heating filament 33 in parallel, the circuit thus formed is then connected to the switch and the overload protection device 4. The switch 5 is provided with a movable or rotatable button 51 with one end protruding out of the housing 1 so that a user can control the switch 5 by using the button 51.

With the above configuration, the user can push or rotate the button 51 to an on position so that the electric power is supplied from the battery 6 to the motor 2 and the electric heating element 3, causing the electric heating element 3 to generate heat and the motor 2 to drive the fan 21 so that hot air generated by the electric heating element 3 is blown out of the housing 1 from the opening 11. Since the electric power is supplied by the battery 6, the use of the dryer will not be limited by the length of a wire connecting the dryer and a receptacle.

Figure 2:
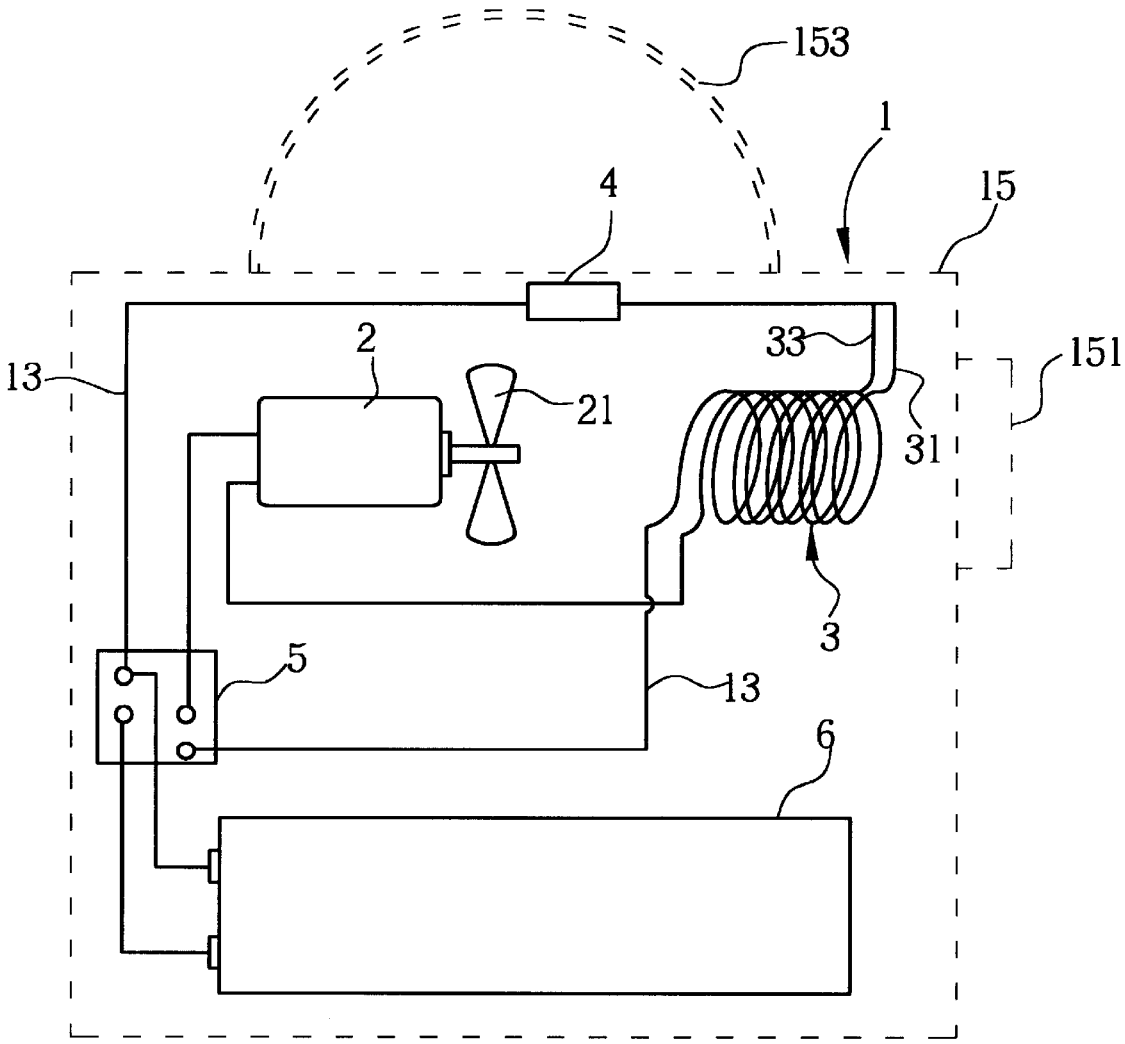
FIG. 2 is a schematic view of a portable dryer according to another embodiment of the present invention.

Referring now to FIG. 2, which is a schematic view of another portable dryer according to another embodiment of the present invention. In this embodiment, the housing 1 is a hollow box 15. The box 15 having an air outlet 151 on one side, and a handle 153 installed on the top of the box 15.

Inside the housing 1 are a motor 2, an electric heating element 3 and an overload protection device 4 installed between the motor 2 and the air outlet 151, and a switch 5 and a battery 6. The battery 6 is connected to the switch 5, the motor 2, the electric heating device 3 and the overload protection device 4 through wires 13, forming a closed circuit loop. A fan 21 is installed on the motor 2. The electric heating device 3 comprises a first heating filament 31 and a second heating filament 33 (in the current embodiment, the first and second heating filaments 31, 33 each can be formed by more than one heating filament) . The first heating filament 31 first connects to the motor 2 in series, which are then connected to the second heating filament 33 in parallel, the circuit thus formed is then connected to the switch 5 and the overload protection device 4.

The user can push or rotate the button 51 to an on position so that the power can be supplied from the battery 6 to the motor 2 and the electric heating element 3, causing the electric heating element 3 to generate heat and the motor 2 to drive the fan 21 so that hot air generated by the electric heating device 3 is blown out of the housing 1 from the air outlet 151.

Figure 3:
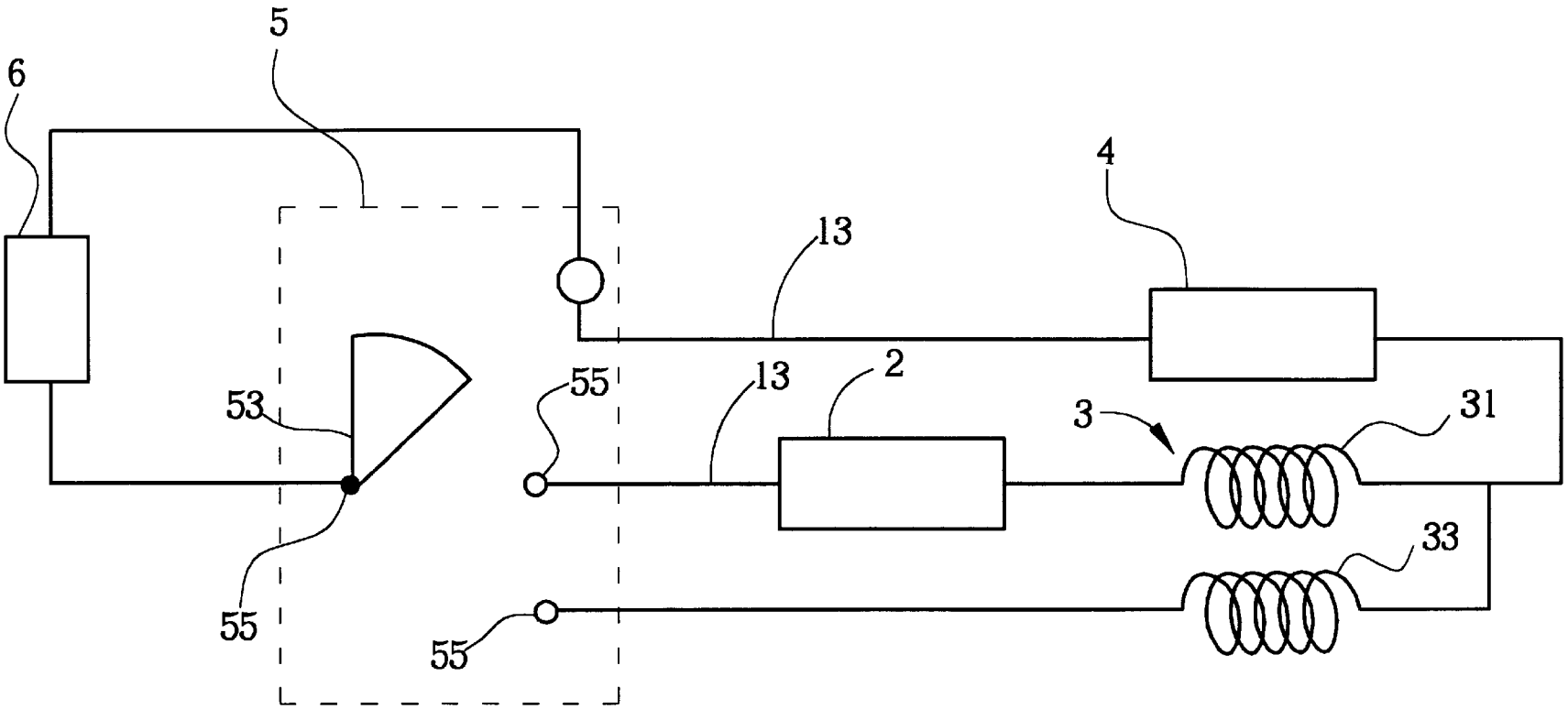
FIGS. 3 to 5 are circuit diagrams of a first circuit according to the present invention.
Figure 4:
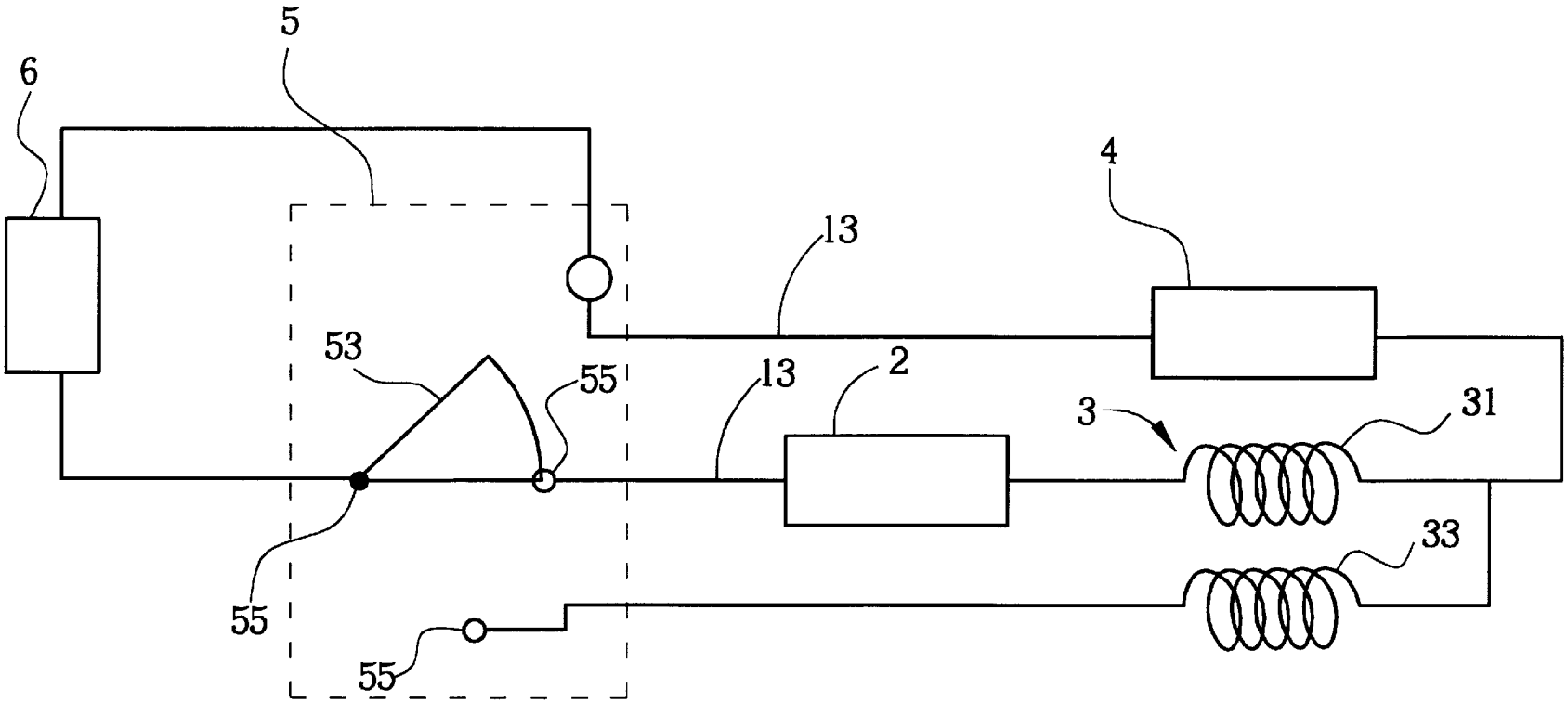
Figure 5:
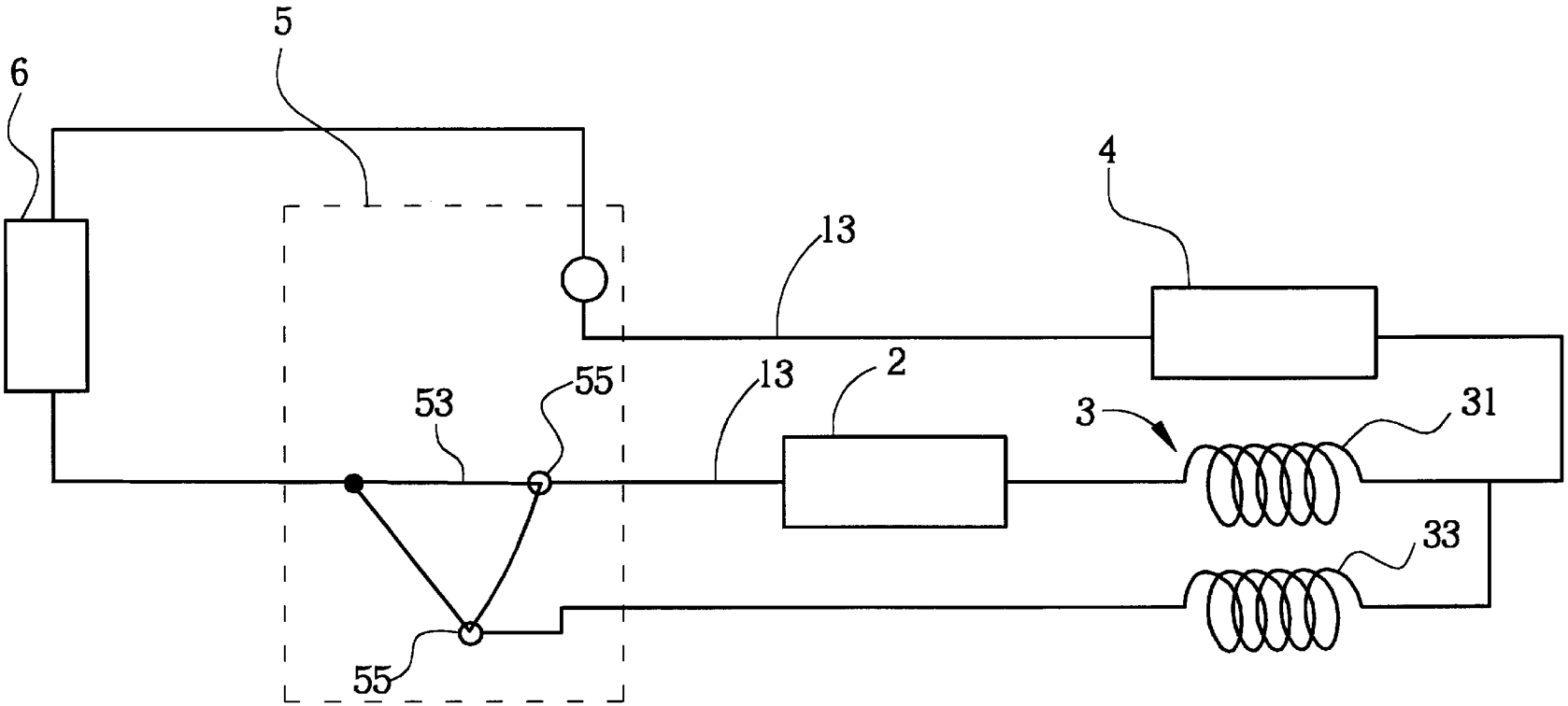

Referring now to FIGS. 3 to 5, which are circuit diagrams of a first circuit according to the present invention. In this embodiment, the switch 5 comprises a fan shaped conductor 53 and a plurality of connecting nodes 55. The conductor 53 is coupled to the battery 6 via a wire 13, the connecting end of the conductor 53 to the battery 6 is pivotally coupled to the switch 5. The connecting nodes 55 are coupled to an overload protection device 4, the first and second heating filaments 31, 33 and the motor 2, forming a closed circuit loop. When the conductor 53 is not rotated, the battery 6 is not electrically connected to the motor 2 and the electric heating element 3 (as shown in FIG. 3) so that the motor 2 does not run and the electric heating element 3 does not generate heat.

By rotating the conductor 53, the motor 2 and the first heating filament 31 of the electric heating device 3 are electrically connected to the battery 6, forming a closed circuit loop (as shown in FIG. 4) powered by the battery 6. Since the resistance of the overload protection device 4 is relatively small comparing with the motor 2 and the heating filaments 31, 33, it is ignored henceforth. We then have:

the total resistance $R=R_{DCM}+R_{1A}$ where $R_{DCM}$ is the internal resistance of the motor 2 and $R_{1A}$ is the resistance of the first heating filament 31;

the total current $I=V/(R_{DCM}+R_{1A})$ , where V is the total output voltage of the battery 6;

the voltage difference between both ends of the motor 2 is $V_{DCM}=R_{DCM}\cdot V/(R_{DCM}+R_{1A})$ ;

the power generated by the motor 2 is $W_{DCM}=R_{DCM}\cdot V^2/(R_{DCM}+R_{1A})^2$; and the total power is $W=V^2/(R_{DCM}+R_{1A})$ In the case that the conductor 53 is rotated further to electrically couple to the battery 6 with the first and second heating filaments 31, 33 and the motor 2 (as shown in FIG. 5). Then, the total resistance $R'=(R_{DCM}+R_{1A})R_2/(R_{DCM}+R_{1A}+R_2)$ where $R_2$ is the resistance of the second heating filament 33;

the total current $I'=V\cdot(R_{DCM}+R_{1A}+R_2)/((R_{DCM}+R_{1A})R_2)$, where V is the total output voltage of the battery 6;

the voltage difference between both ends of the motor 2 is $V'_{DCM}=R_{DCM}\cdot V/(R_{DCM}+R_{1A})$;

the current on the motor 2 is $I'_{DCM}=V/(R_{DCM}+R_{1A})$;

the power generated by the motor 2 is $W'_{DCM}=R_{DCM}\cdot V^2/(R_{DCM}+R_{1A})^2$; and the total power is $W'=V^2\cdot(R_{DCM}+R_{1A}+R_2)/((R_{DCM}+R_{1A})R_2)$.

With reference to FIG. 6, which shows power generated from the first circuit. One can calculate from the above equations that $W_{DCM}/W_{DCM}=1$, which means that the rotational speed of the motor 2 does not change. But the total power ratio W'/W=1.55, which means that the heat is increased by a factor of 1.55. Therefore, when the conductor 56 is rotated, although the rotational speed of the motor 2 remains constant and produces the same amount of airflow, the heat generated will be different because the second heating filament 33 will generate additional heat as well.

Figure 7:
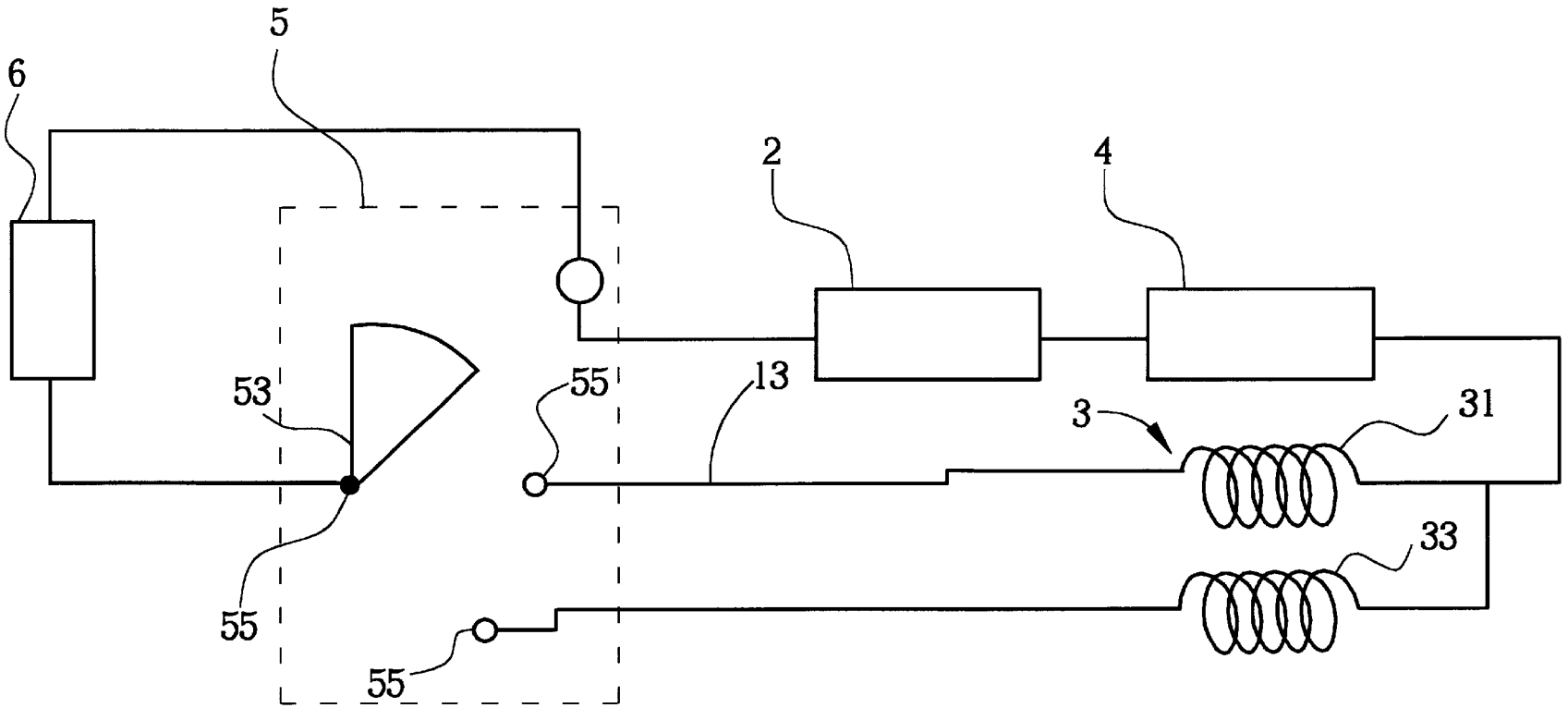
FIGS. 7 to 9 are circuit diagrams of a second circuit according to the present invention.
Figure 8:
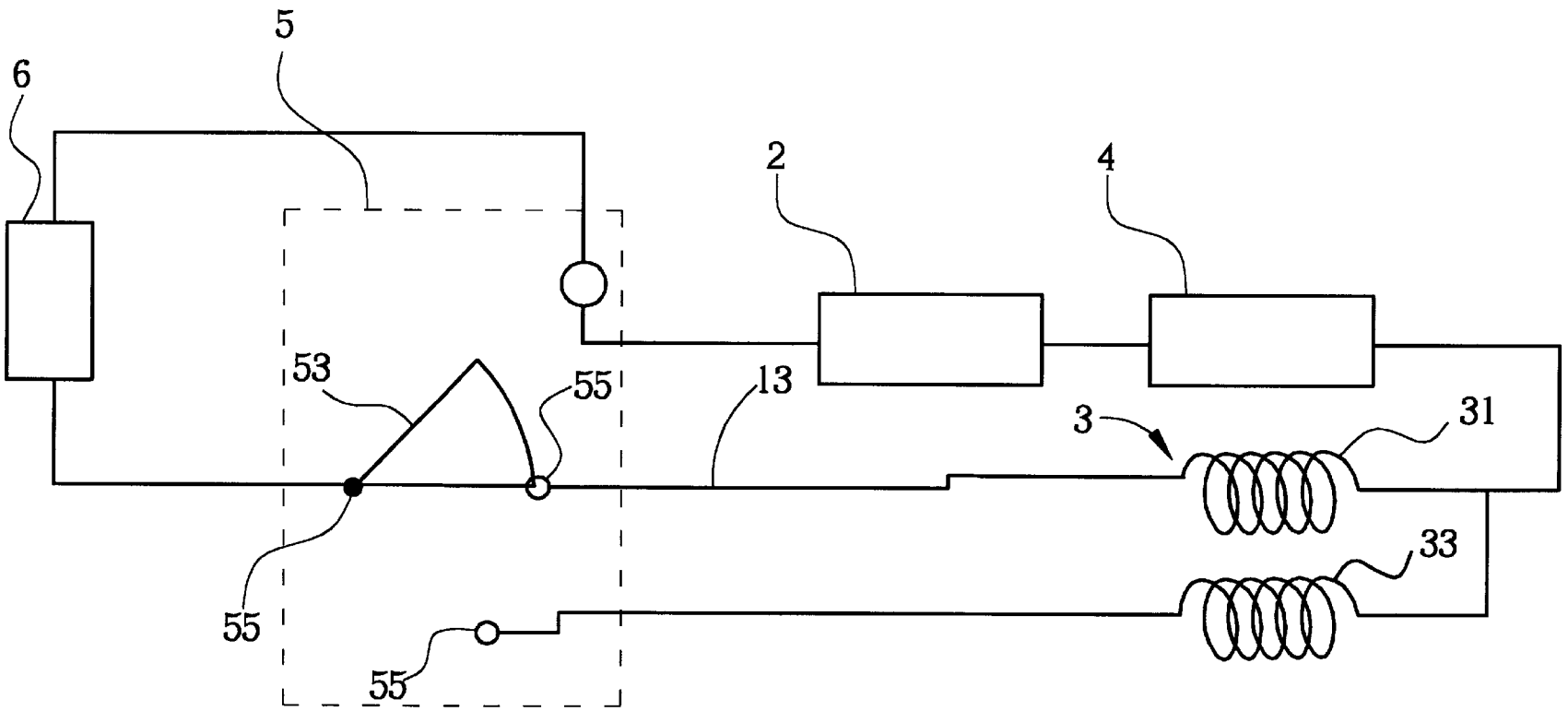
Figure 9:
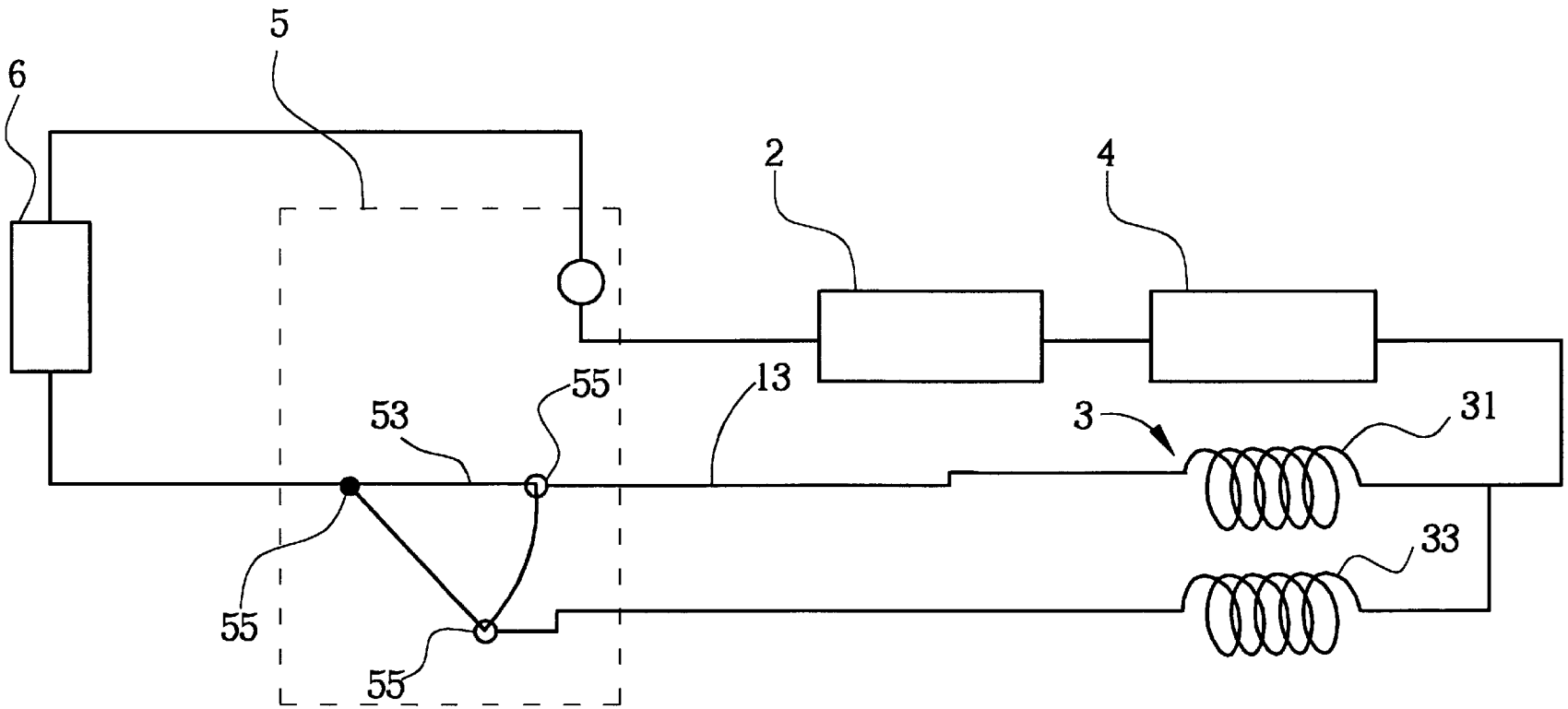

Referring now to FIGS. 7 to 9, which illustrates circuit diagrams of a second circuit according to the present invention. The switch 5 comprises a fan shaped conductor 53 and a plurality of connecting nodes 55. The conductor 53 is coupled to the battery 6 via a wire 13, the connecting end of the conductor 53 to the battery 6 is pivotally coupled to on the switch 5. The connecting nodes 55 are coupled to an overload protection device 4, the first and second heating filaments 31, 33 and the motor 2, forming a closed circuit loop. When the conductor 53 is not rotated, the battery 6 is not electrically connected with the motor 2 and the electric heating element 3 (as shown in FIG. 7) so that the motor 2 does not run and the electric heating element 3 does not generate heat.

By rotating the conductor 53, the motor 2 and the first heating filament 31 become electrically connected with the battery 6, forming a closed circuit loop (as shown in FIG. 8) powered by the battery 6. We then have:

the total resistance $R=R_{DCM}+R_{1A}$, where $R_{DCM}$ is the internal resistance of the motor 2 and $R_{1A}$ is the resistance of the first heating filament 31;

the total current $I=V/(R_{DCM}+R_{1A})$, where V is the total output voltage of the battery 6;

the voltage difference between both ends of the motor 2 is $V_{DCM}=R_{DCM}\cdot V/(R_{DCM}+R_{1A})$;

the power generated by the motor 2 is $W_{DCM}=R_{DCM}\cdot V^2/(R_{DCM}+R_{1A})^2$; and the total power is $W=V^2/(R_{DCM}+R_{1A})$.

In the case that the conductor 53 is rotated further to electrically couple to the first and second heating filaments 31,33 with the battery 6 (as shown in FIG. 9). Then, the total resistance $R'=R_{DCM}+(R_{1A}\cdot R_{1B})/(R_{1A}+R_{1B})$, where $R_{1B}$ is the resistance of the second heating filament 33;

the total current is $I'=V/(R_{1A}+R_{1B})/((R_{1A\cdot R1B})+(R_{1A}+R_{1B})R_{DCM})$;

the power generated by the motor 2 is $W'_{DCM}=I'_2\cdot R_{DCM}$;

the total power is $W'=V^2/R'$.

With reference to FIG. 10, which shows power generated from the second circuit. One can calculate from the above equations that by adjusting the resistance $R_{1B}$ of the second heating filament 33, the speed of the motor 2 can be changed. Suppose $R_{1B}=42\ \Omega$, the power of the motor 2 can be doubled and the output airflow is thus doubled. This agreement has the advantage over the first circuit in which the motor speed is adjustable in the second circuit. Owing to the characteristic of the circuit, the total power output of the second circuit is limited by $R_{1B}$. If the motor power is increased by a factor of N, the total power is increased by a factor of $N^{1/2}$ only.

Figure 11:
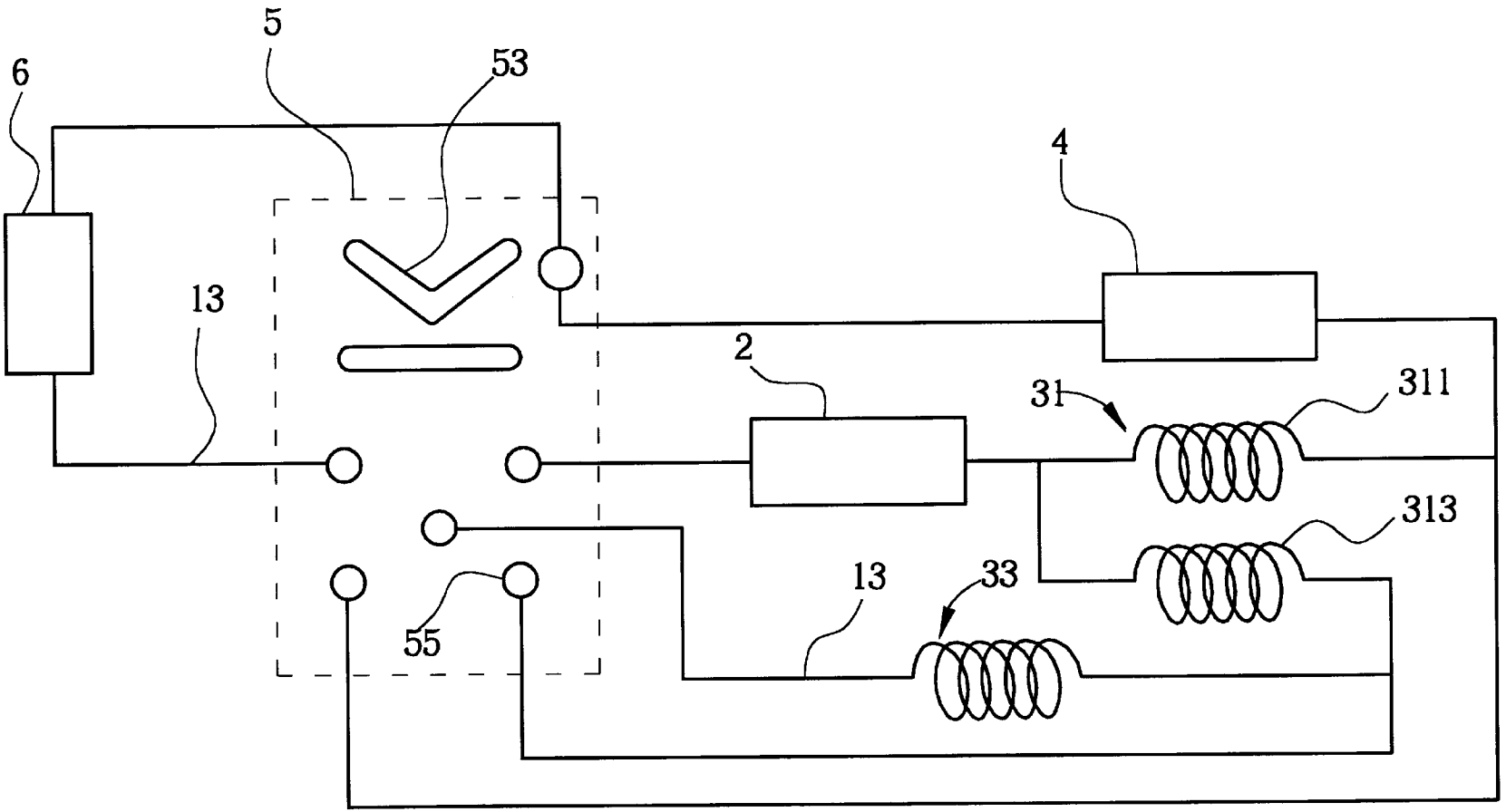
FIGS. 11 to 13 are circuit diagrams of a third circuit according to the present invention.
Figure 12:
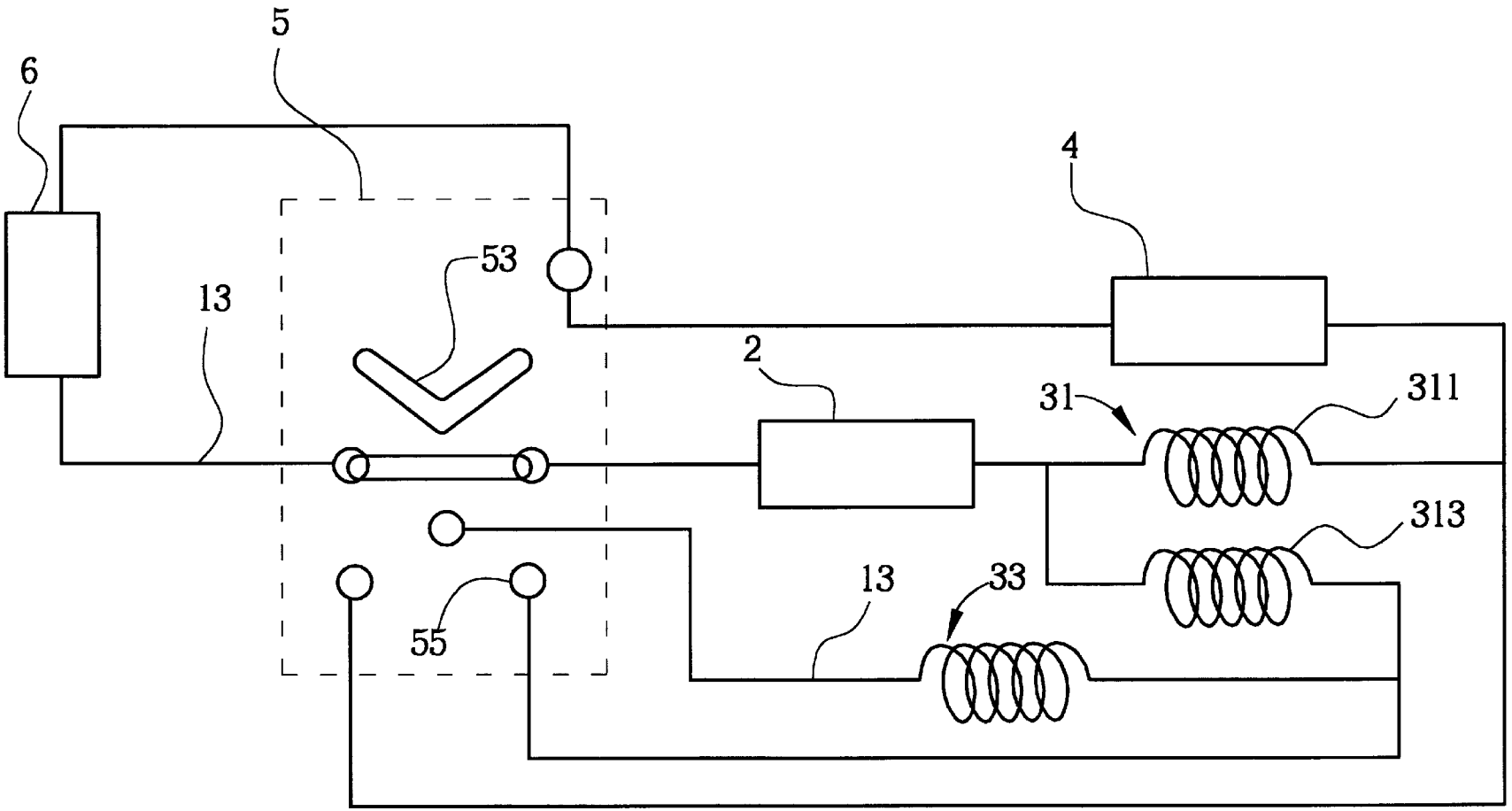
Figure 13:
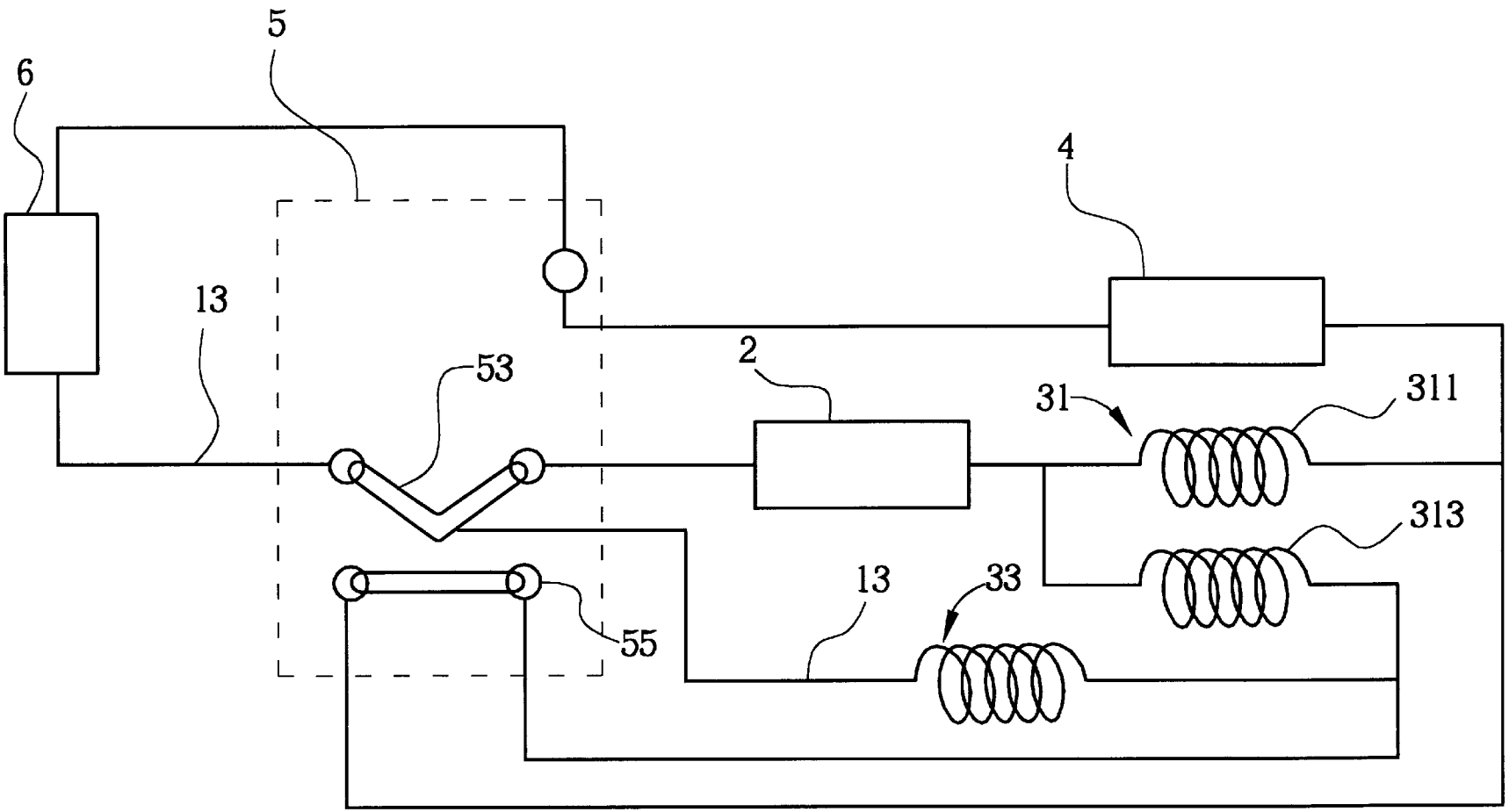

Referring to FIGS. 11 to 13, which show circuit diagrams of a third circuit according to the present invention. The switch 5 comprises a conductor 53 and a plurality of connecting nodes 55. The conductor 53 is connected to the battery 6 via a wire 13 and can be slid over some of the connecting nodes 55. The connecting nodes 55 are coupled to an overload protection device 4, the first and second heating filaments 31, 33 and the motor 2. The first heating filament 31 includes a third heating filament 311 and a fourth heating filament 313, which are arranged in parallel. The connecting nodes 55 are coupled to the overload protection device 4, the third, fourth and second heating filaments 311, 313, 33 and the motor 2, forming a closed circuit loop. When the conductor 53 is not engaged, the battery 6 is not electrically connected to the motor 2 and the electric heating device 3 so that the motor 2 does not run and the electric heating device 3 does not generate heat (as shown in FIG. 11).

When the conductor 53 is shifted to the position as shown in FIG. 12, the motor 2 and the third heating filament 311 are electrically coupled to the battery 6, forming a closed circuit loop powered by the battery 6. We then have:

the power generated by the motor 2 is $W_{DCM}=R_{DCM}\cdot V^2/(R_{DCM}+R_{1A})^2$, where RDCM is the internal resistance of the motor 2, $R_{1A}$ is the resistance of the third heating filament 311 and V is the total output voltage of the battery 6;

the total power is $W=V^2/(R_{DCM}+R_{1A})$.

Referring to FIG. 13, wherein the conductor 53 is further shifted to electrically couple the motor 2 with the third, fourth and second heating filaments 311, 313, 33 and the battery 6. Then, the resistance of the first heating filament 31 $R_1=R_{1A}\cdot R_{1B}/(R_{1A}+R_{1B})$, where RiB is the resistance of the fourth heating filament 313;

the power generated by the motor 2 is $W'_{DCM}=V^2\cdot R_{DCM}/(R_{DCM}+R_1)^2$;

the total power is $W'=V^2\cdot(R_{DCM}+R_1+R_2)/((R_{DCM}+R_1)R_2)$, where $R_2$ represents the resistance of the second heating filament 33.

Please refer to FIG. 14, which shows power generated from the third circuit. As shown in FIG. 14, one can calculate from the above equations that $W'_{DCM}/W_{DCM}=2$. That is, the rotational speed of the motor 2 doubles. But the total power ratio W'/W=2.15, which means that the heat is increased by a factor of 2.15. Therefore, by adjusting the $R_{1B}$ of the fourth heating filament 311 and controlling the switch 5, the speed of the motor 2 can be changed. Adjusting the $R_2$ value can control the total output power, which improves the second circuit of the invention where the total output power is limited by the motor power.

Figure 15:
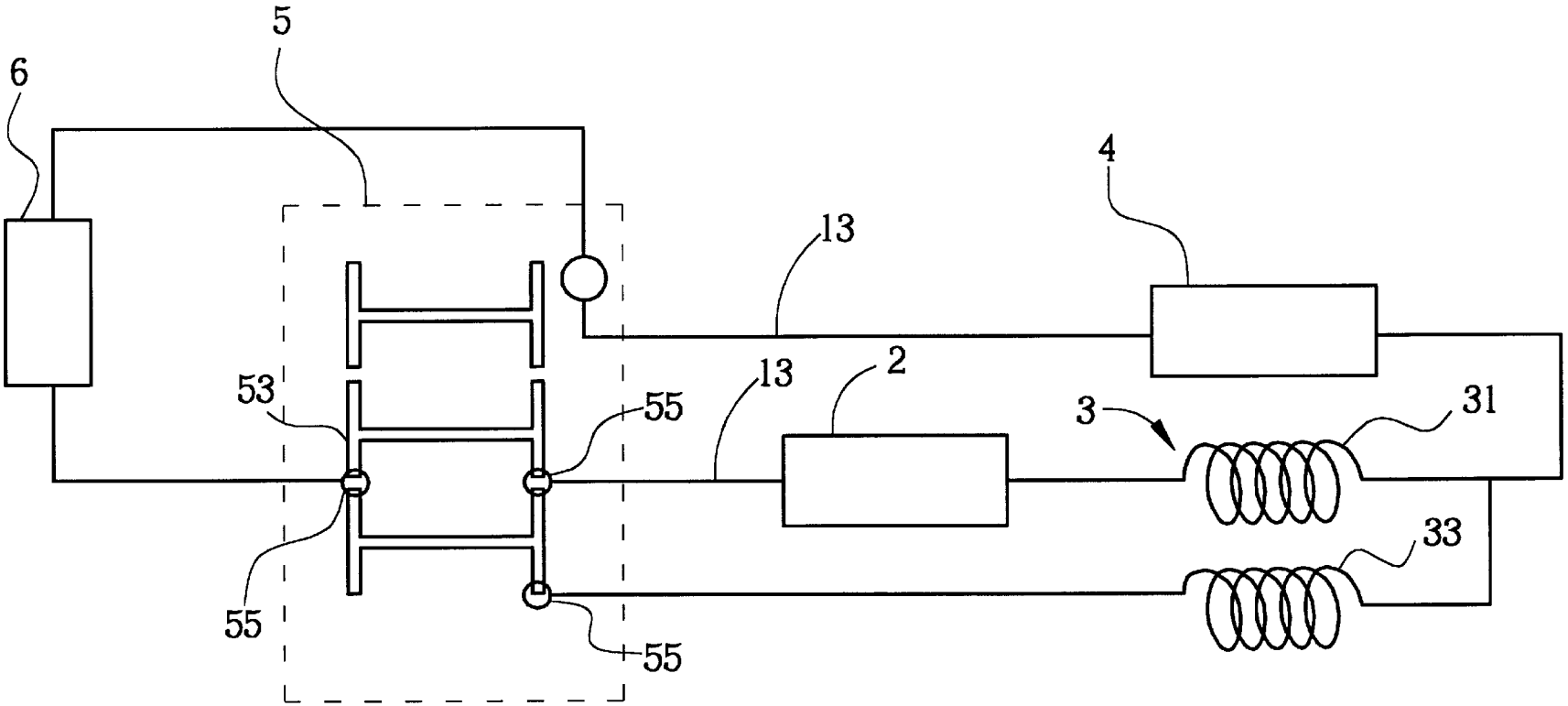
FIG. 15 is a circuit diagram of a fourth circuit according to the present invention.

Referring now to FIG. 15, which shows a circuit diagram of a fourth circuit according to the present invention. The switch 5 includes an H shaped conductor 53 and a plurality of connecting nodes 55. One of the connecting nodes 55 is coupled to the battery 6 by a wire 13. The conductor 53 is slid over a portion of the connecting nodes 55. The connecting nodes 55 are coupled to an overload protection device 4, the first and second heating filaments 31,33 and the motor 2 via wires 13. By sliding the conductor 53, the motor 2 and the first heating filament 31 are electrically coupled to the battery 6. Or the motor 2 and the first and second heating filaments 31,33 are electrically coupled to the battery 6. The electric heating device 3 then generates different amounts of heat and the motor 2 runs at different speeds, causing the fan 21 to blow out hot air with different speeds and temperatures.

Comparing to the related art, the portable dryers of the present invention are powered by batteries, not by power cords. Thus their usage is not limited by their distances from receptacles. Moreover, through different arrangements of the electric heating device the motor speed can either be fixed or changed to obtain different heating output.

Those skilled in the art will readily observe that numerous modifications and alterations of the device may be made while retaining the teachings of the invention. Accordingly, the above disclosure should be understood to be limited only by the bounds of the following claims.

What is claimed is:

1. A portable dryer comprising:

a housing with an opening at one end thereof;

a motor having a fan installed inside said housing;

two heating filaments coupled in parallel;

a switch electrically coupled to the motor; and a battery electrically coupled to the switch, the motor and the coupled heating filaments in series for supplying electric power;

wherein the switch is capable of being controlled to electrically disconnect both heating filaments from the motor, to electrically connect the motor with only one of the heating filaments, or to electrically connect the motor with both heating filaments.

2. The portable dryer of claim 1, wherein the electric heating device comprises a first heating filament and a second heating filament, the first heating filament being coupled to the motor in series, which are then coupled to the second heating filament in parallel, forming a circuit coupled to the switch and the battery.

3. The portable dryer of claim 2, wherein the first heating filament comprises a third heating filament, and a fourth heating filament coupled in parallel to the third heating filament.

4. The portable dryer of claim 2, wherein the switch comprising a conductor and a plurality of connecting nodes, one end of the conductor being pivotally coupled to the switch, and through the connection with the battery via a wire the other end of the conductor being able to get into electrical contact with the plurality of connecting nodes by rotation, so that the plurality of connecting nodes being controlled to be electrically disconnected from the motor and the second heating filament, or to be electrically connected with the motor, or to be electrically connected with both the motor and the second heating filament.

5. The portable dryer of claim 4, wherein the conductor is of an approximately fan shape.

6. The portable dryer of claim 2, wherein the switch comprises a displaceable conductor, where the displaceable conductor being able to be shifted to electrically disconnect the battery from the motor and the second heating filament, or to electrically connect the battery with the motor, or to electrically connect both the motor and the second heating filament.

7. The portable dryer of claim 6, wherein the conductor is of an approximately H in shape.

8. The portable dryer of claim 1, wherein the electric heating device comprises a first heating filament and a second heating filament, the first heating filament first being coupled to the second heating filament in parallel and then to the motor in series, then to the switch and the battery.

9. The portable dryer of claim 1, wherein the switch comprising a conductor and a plurality of connecting nodes, one end of the conductor being pivotally coupled to the switch, and through the connection with the battery via a wire the other end of the conductor being able to get into electrical contact with the plurality of connecting nodes by rotation, so as to electrically disconnect both heating filaments from the motor, to electrically connect the motor with only one of the heating filaments, or to electrically connect the motor with both heating filaments.

10. The portable dryer of claim 9, wherein the conductor is of an approximately fan shape.

11. The portable dryer of claim 8, wherein the switch comprises a displaceable conductor, where the displaceable conductor being able to be shifted to electrically disconnect the battery from the motor and the second heating filament, or to electrically connect the battery with the motor, or to electrically connect both the motor and the second heating filament.

12. The portable dryer of claim 11, wherein the conductor is of an approximately H in shape.

13. The portable dryer of claim 1 further comprising an overload protection device electrically coupled to the battery for preventing damages to the portable dryer.

14. The portable dryer of claim 13, wherein the overload protection device is a fuse.

15. The portable dryer of claim 1, wherein the battery is a dry cell battery.

16. The portable dryer of claim 1, wherein the battery is a rechargeable battery.

17. The portable dryer of claim 1 further comprising a handle installed on the housing for carrying the portable dryer.

18. The portable dryer of claim 1, wherein the switch comprises a displaceable conductor, where the displaceable conductor being able to be shifted to electrically disconnect both heating filaments from the motor, to electrically connect the motor with only one of the heating filaments, or to electrically connect the motor with both heating filaments.

19. The portable dryer of claim 18, wherein the conductor is of an approximately H in shape.

* * * * *